US008534492B2

(12) United States Patent
Smyers et al.

(10) Patent No.: US 8,534,492 B2
(45) Date of Patent: Sep. 17, 2013

(54) CONTAINER WITH AIR-TIGHT LID

(75) Inventors: Justin Smyers, Newport Beach, CA (US); Michael E. Williams, Canyon Lake, CA (US)

(73) Assignee: WKI Holding Company, Inc., Rosemont, IL (US)

( * ) Notice: Subject to any disclaimer, the term of this patent is extended or adjusted under 35 U.S.C. 154(b) by 0 days.

(21) Appl. No.: 13/078,855

(22) Filed: Apr. 1, 2011

(65) Prior Publication Data

US 2012/0248116 A1 Oct. 4, 2012

(51) Int. Cl.

| | |
|---|---|
| ***B65D 41/16*** | (2006.01) |
| ***B65D 45/16*** | (2006.01) |
| ***B65D 53/00*** | (2006.01) |
| ***B65D 21/00*** | (2006.01) |

(52) U.S. Cl.
USPC ..... 220/780; 220/326; 220/240; 206/511

(58) Field of Classification Search
USPC ..... 220/326, 240, 780, 784, 790, 795, 220/309.2, 310.1, 315, 838, 806, 345.6, 324, 220/221, 224, 226, 233, 295, 309; 206/511, 206/512
See application file for complete search history.

(56) References Cited

U.S. PATENT DOCUMENTS

| | | | | |
|---|---|---|---|---|
| 2,004,008 | A | 6/1935 | Minnelli | |
| 3,688,942 | A * | 9/1972 | Mitchell et al. | 220/784 |
| 4,951,832 | A | 8/1990 | Tenney et al. | |
| 5,065,885 | A | 11/1991 | Scaroni | |
| 5,184,745 | A | 2/1993 | Havens et al. | |
| 5,395,003 | A | 3/1995 | Matsuda | |
| 6,415,947 | B1 * | 7/2002 | Kim | 220/788 |
| 6,729,472 | B2 | 5/2004 | Stucke et al. | |
| 6,793,096 | B1 * | 9/2004 | Seok | 220/788 |
| 7,090,089 | B2 | 8/2006 | Lown et al. | |
| 7,854,344 | B2 * | 12/2010 | Suk | 220/326 |
| 2004/0084464 | A1 * | 5/2004 | Koo | 220/784 |
| 2005/0006390 | A1 * | 1/2005 | Wang | 220/326 |
| 2005/0035125 | A1 | 2/2005 | Bae | |
| 2005/0139604 | A1 * | 6/2005 | Kim | 220/788 |
| 2008/0110911 | A1 * | 5/2008 | Chen | 220/788 |
| 2009/0008284 | A1 | 1/2009 | Lown et al. | |
| 2009/0078715 | A1 * | 3/2009 | Kim | 220/782 |

* cited by examiner

*Primary Examiner* — Bryon Gehman
*Assistant Examiner* — Shawn Braden
(74) *Attorney, Agent, or Firm* — Larry K. Roberts

(57) ABSTRACT

A storage system including, in an exemplary embodiment, a unitary open-topped container, and an air-tight lid system, suitable for storage of food items. The lid system includes a plastic lid including a cover portion and a plurality of lid latches connected to the lid cover portion by living hinges, and a seal gasket fitted into an inner seal channel formed in a lid peripheral region. The latches are configured for movement between extended positions in which the lid is removable from the container, and a latching position in which latch features engage a peripheral edge of the container to secure the lid and gasket in a sealed position on the container.

9 Claims, 13 Drawing Sheets

CONTAINER WITH AIR-TIGHT LID

BACKGROUND

Containers such as bowls for food items and the like have sometimes been provided with lids. However, the container/lid combinations have typically been susceptible to leakage, or difficulties in securing the lid to the container.

BRIEF DESCRIPTION OF THE DRAWINGS

Features and advantages of the disclosure will readily be appreciated by persons skilled in the art from the following detailed description when read in conjunction with the drawing wherein.

DETAILED DESCRIPTION

Figure 1:
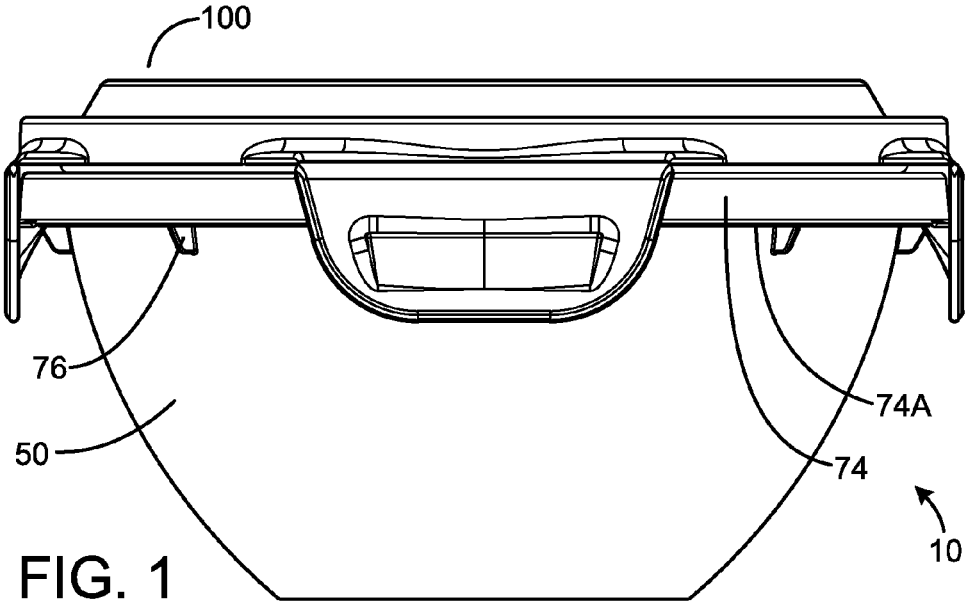
FIG. 1 is a front view of an exemplary embodiment of a bowl with a lid in a secured position.
Figure 2:
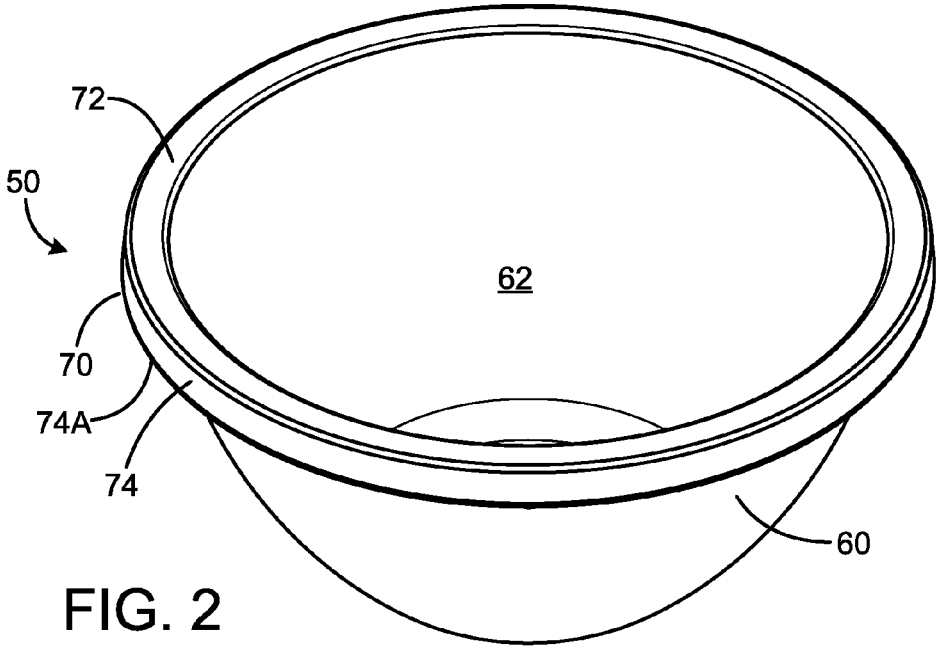
FIG. 2 is an isometric view of the bowl of FIG. 1.

In the following detailed description and in the several figures of the drawing, like elements are identified with like reference numerals.

An exemplary embodiment of this invention includes a plastic container with an air-tight lid system, suitable for storage of food items, for example. The lid system includes a plastic lid including a cover portion and a plurality of lid latches connected to the lid cover portion by living hinges. A seal gasket is fitted into an inner seal groove or channel formed in a lid periphery. The latches are configured for movement between extended positions in which the lid is removable from the bowl, and a latching position in which latch features engage the bowl to secure the lid and gasket in a sealed position on the bowl.

FIGS. 1-8C illustrate an exemplary embodiment of the container with air-tight lid system, in which the combination is designated generally as 10. The container 50 in this embodiment takes the form of a bowl having a generally concave shape with an open top. The container 50 includes bowl portion 60 and a top peripheral lip portion 70. The bowl portion 60 defines an interior bowl volume 62. The top peripheral lip portion 70 includes a flat, planar annular rim portion 72 extending from the top edge of the bowl portion, with a distal edge of the rim portion 72 terminating in a downwardly extending wall portion 74 having a lower edge 74A. The wall portion 74 is spaced from the upper region of the bowl portion, defining a channel between the wall portion and the adjacent exterior surface of the bowl portion.

Figure 8A:
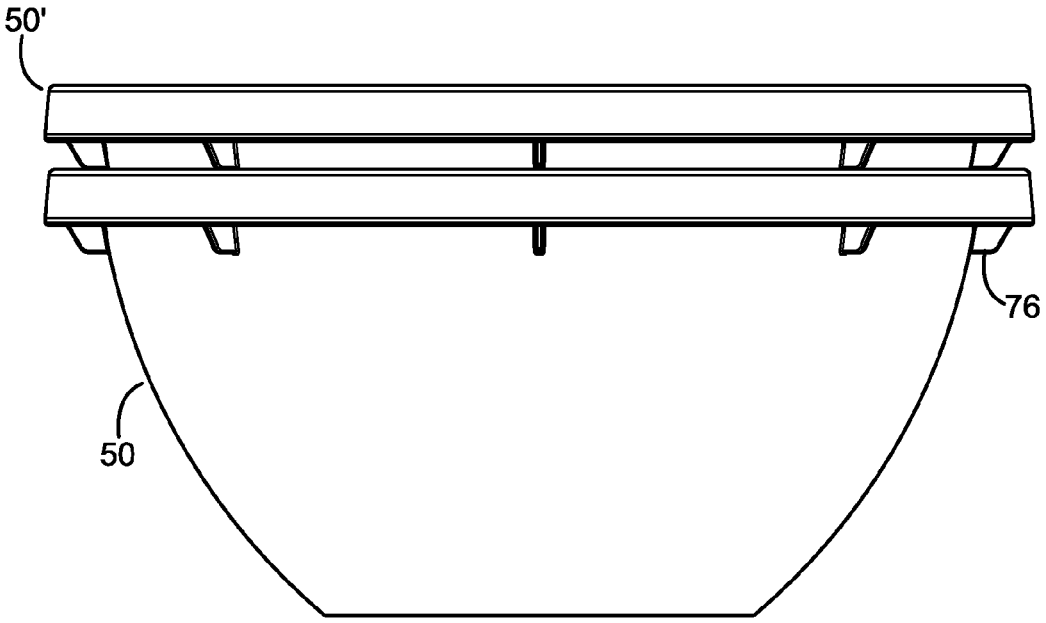
FIGS. 8A, 8B and 8C illustrate stacking of like bowls, showing two like bowls in a stacked relationship.
Figure 8B:
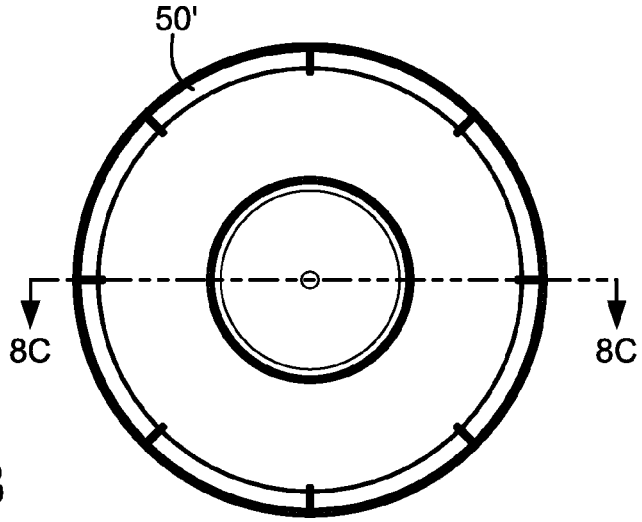
Figure 8C:
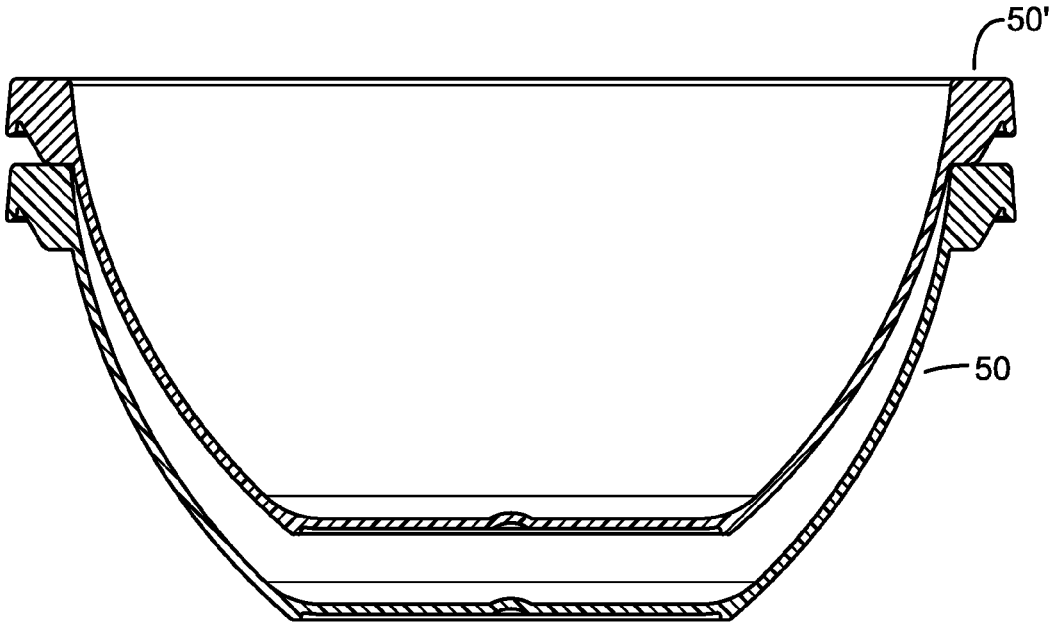

A plurality of spaced rib portions 76 are formed between the bowl portion and the wall portion 74 to provide strengthening features. In an exemplary embodiment, the rib portions are spaced at 45 degree intervals about the periphery of the bowl portion. Another function of the rib portions 76 is to provide nesting stops for like bowls for secure, flat/uniform stacking of vessels. Stacking of like bowls is illustrated in FIGS. 8A-8C, which shows like bowls 50 and 50' in a stacked relationship. The rib portions 74 include in this embodiment generally flat bottom surfaces 74A, and with the like bowls in a stacked relationship, the flat bottom surface 74A of an upper bowl rests on the flat rim surface 72 of the lower bowl.

Interference between the rib portions 74 and the lid latches is prevented by latch relief regions 74B (FIG. 7B) formed between the ribs and the wall portion 74.

The depth of the wall portion, i.e. the vertical distance from the rim to the edge 74A, may be selected in coordination with the latch configuration and dimensions.

Figure 3:
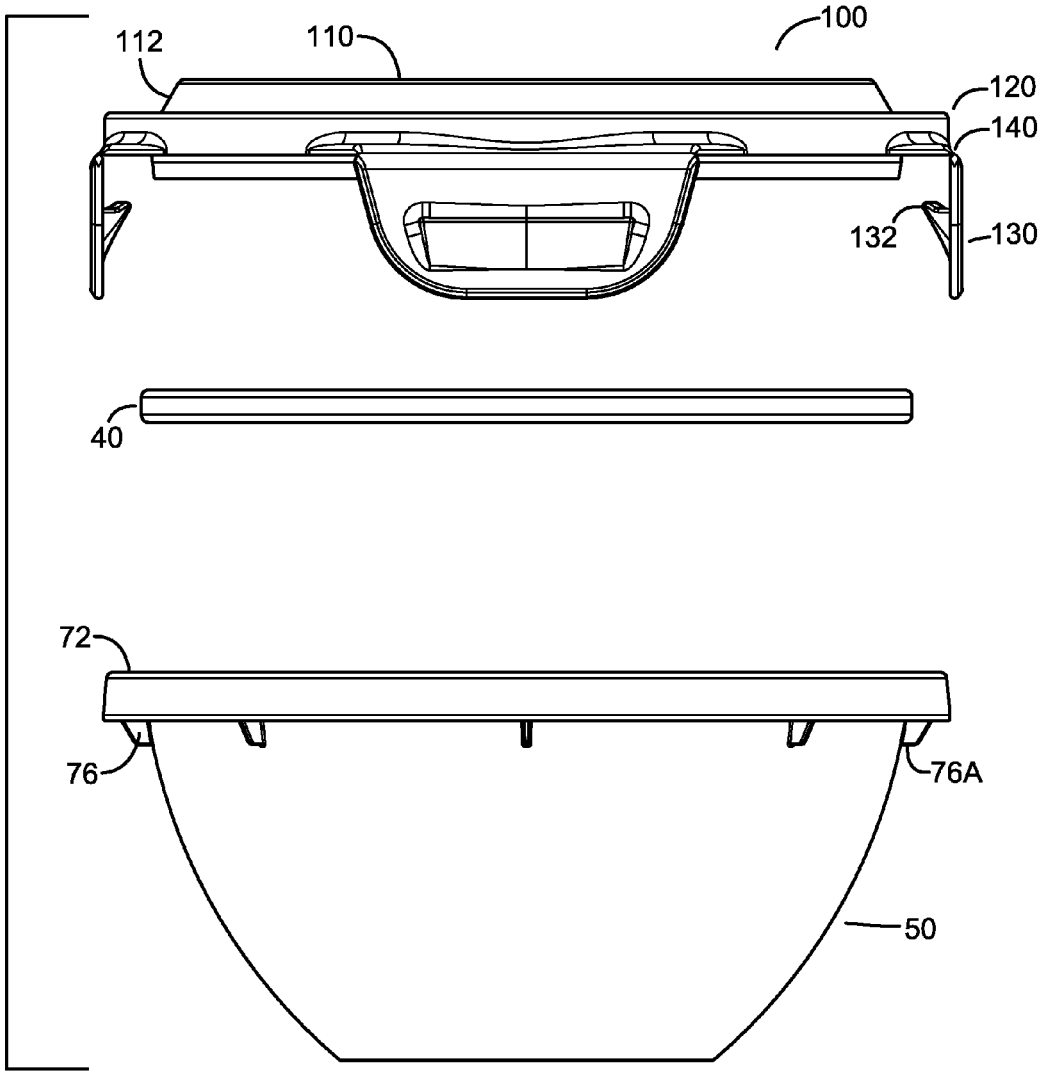
FIG. 3 is an front elevation exploded view of the bowl and lid of FIG. 1, showing a seal member.
Figure 3A:
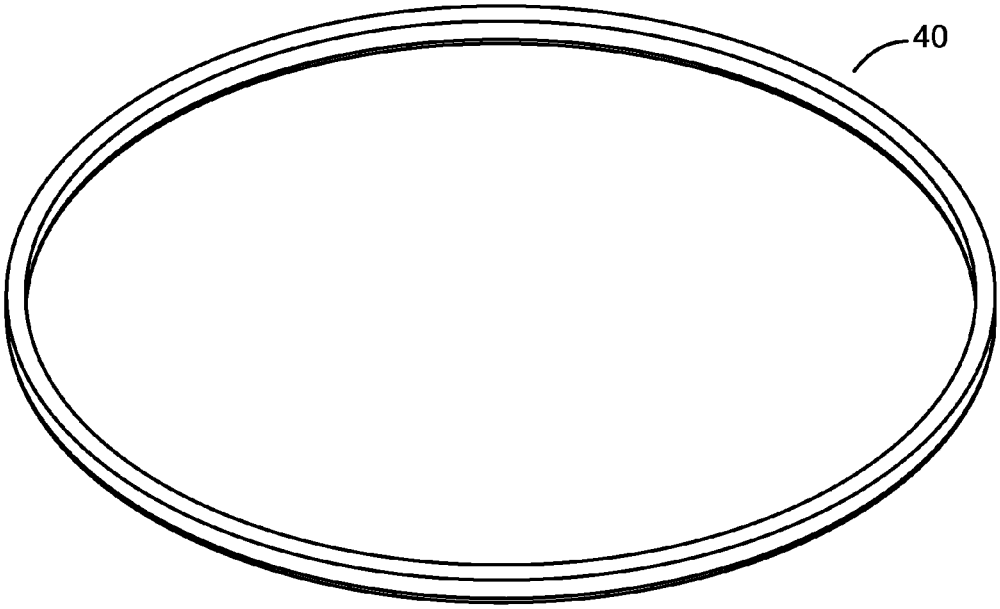
FIG. 3A is an isometric view of an exemplary embodiment of the seal member.

FIG. 3 shows the bowl and lid system 10 in exploded view, including the seal member 40, which is held in a channel formed in the lid 100, and is brought into compression between the lid and the inner edge of the bowl rim surface 72 when the lid latches are closed. Further illustrated in FIG. 3A, the seal member 40 may be an extruded or molded elastomeric member. In an exemplary embodiment, the seal member is an injection-molded unitary part, and of solid cross section. The seal member may be made of a silicon or TPE (thermoplastic elastomer). The seal member 40, in the case of a round bowl configuration, is sized to have a diameter of its inner wall generally equivalent to the diameter of the inner edge of the flat peripheral surface 72. The thickness dimension of the seal member in an exemplary embodiment is selected to optimize the tradeoff of moldability of the seal, sufficient thickness to allow appropriate compression properties for the latch seal arrangement, and to provide appropriate rigidity when handling of the seal as it is applied and removed from the lids.

The lid 100 includes a cover surface 110 which is sized to extend over the open top of the bowl when the lid is attached to the bowl 50. The cover surface 110 is generally planar in this embodiment, and is connected to a lid peripheral portion 120 by a beveled or angled surface portion 112, providing a shallow dome structure. The beveled surface portion facilitates stacking of similarly sized lids 100.

The underside of the lid peripheral portion 120 defines two peripheral channels or grooves, an inner channel in which the seal member is received, and an outer channel. Thus, as for example illustrated in FIGS. 6A and 6B, the lid peripheral portion 120 includes a generally annular web portion 122 connected to the edge of the beveled surface portion 112. Intermediate and outer peripheral walls or ribs 124A and 124B extend downwardly and, with the web portion 122, defines the inner channel 126A and the outer channel 126B. The seal member 40 is positioned in the inner channel 126A. A function of the outer channel 126B is to provide rigidity and bridge the gap between the inner channel 126A and the outer edge of the lid.

The lid peripheral portion 120 further includes an inner wall or rib portion 128 which protrudes downwardly, and has an outer diameter dimension sized in cooperation with the inner diameter of the top edge of the bowl portion 60 of the container 50, such that the inner wall portion 128 fits into the bowl portion (see FIGS. 7B and 7C) and provides a lid alignment feature or rib, to align the lid properly with the bowl as the lid is being installed onto the bowl. The rib portion 128, in an exemplary embodiment, is designed to fit around the upwardly projecting lid cover surface 110, so that stacking of like lids is secure and nesting occurs reducing the height requirement for stacks of like lids. The angle on the rib portion 128 provides a lead-in for the lid-to-bowl alignment. The fit of the rib portion and bowl in an exemplary embodiment is sufficiently tight for proper latch alignment to occur but does not provide sealing.

Figure 4:
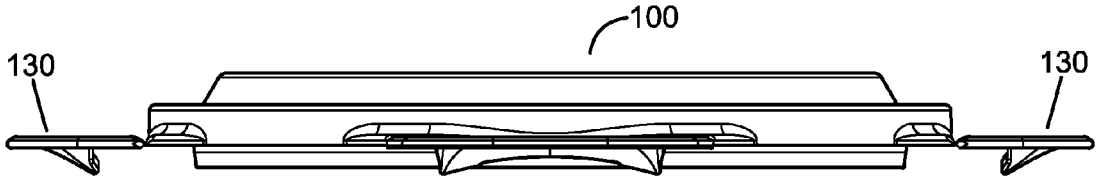
FIG. 4 is a front elevation view of the lid of FIG. 1, shown with the latches in an extended position
Figure 5:
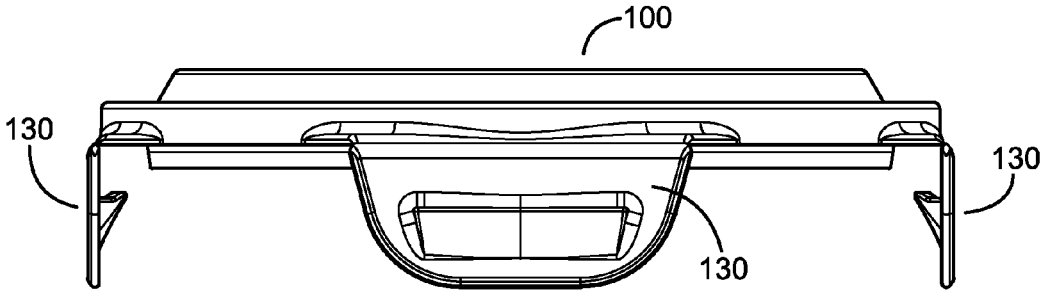
FIG. 5 is a front elevation view of the lid of FIG. 1, shown with the latches in a latch position.
Figure 6B:
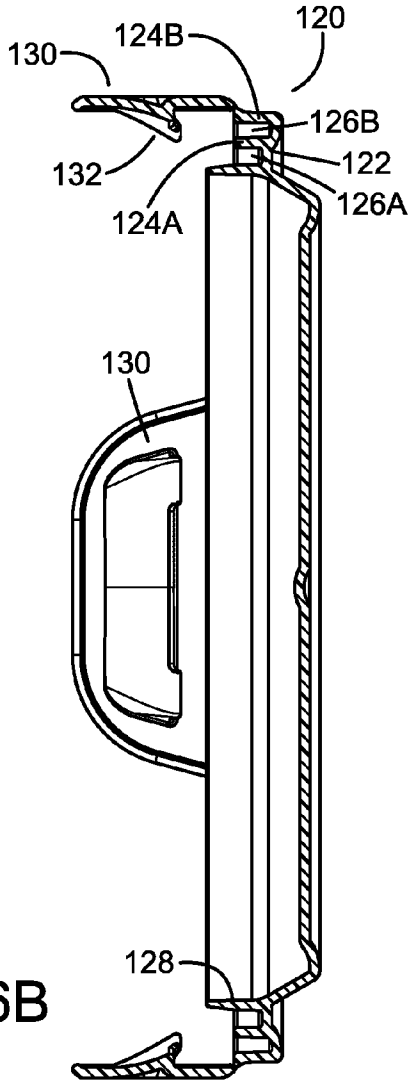
FIG. 6B is a cutaway view, taken along line 6B-6B of FIG. 6A.
Figure 6A:
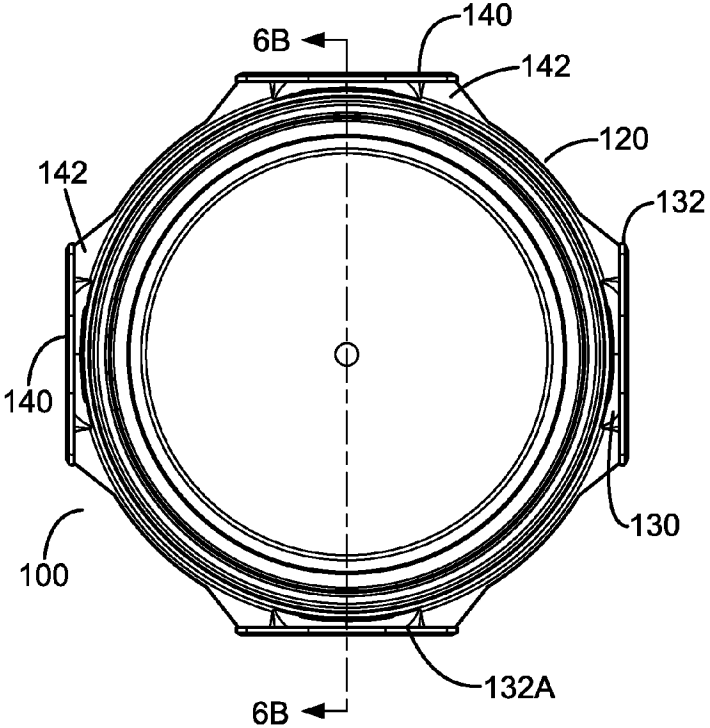
FIG. 6A is a bottom view of the lid as shown in FIG. 5.
Figure 7C:
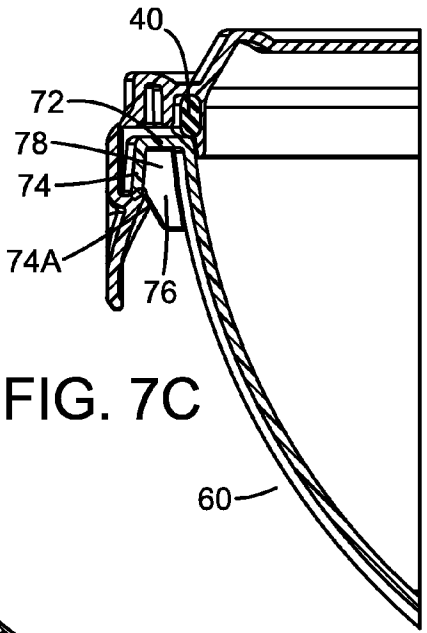
FIG. 7C is a cross-sectional view taken along line 7C-7C of FIG. 7A.
Figure 7B:
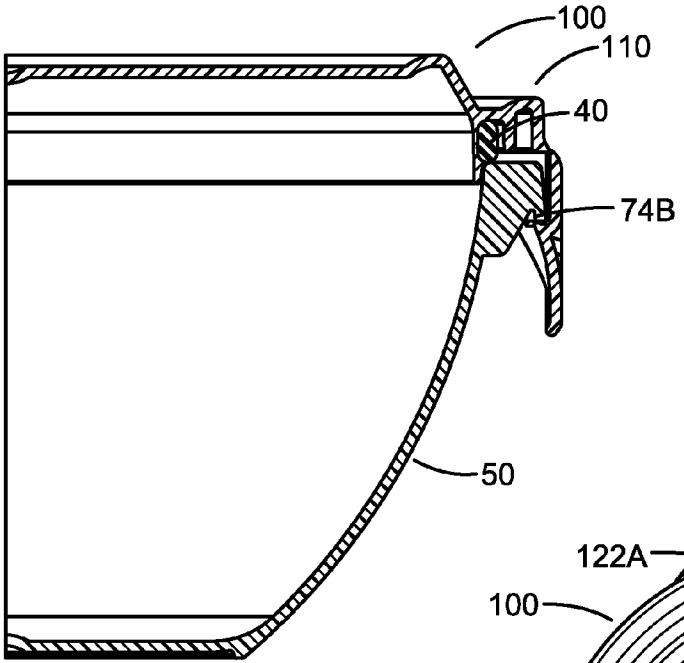
FIG. 7B is a cross-sectional view taken along line 7B-7B of FIG. 7A.
Figure 7A:
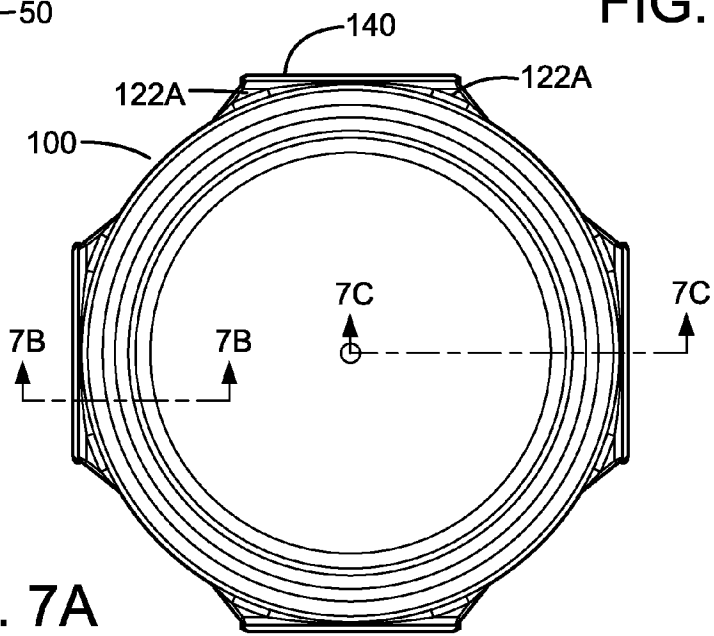
FIG. 7A is a top view of the bowl and lid assembly of FIG. 1.

The latches 130 are connected to the lid peripheral portion 120 at the bottom edge of the outer peripheral wall 124B (FIG. 6B) distal from the annular web portion 122 by living hinges 140, so that the latches may be rotated about the hinges 140 to the downwardly positioned latched position shown in FIGS. 1, 5 and 6B, for example, and upwardly positioned latch release positions such as the position shown in FIG. 4, for example. As such, it will be appreciated that in an exemplary embodiment, the lid is a unitary structure, fabricated from a plastic material such as polypropylene by injection molding. In an exemplary embodiment, the latches have a substantial width to provide robust latching to the bowl. In one example the latches subtend an angle in a range of 30 to 45 degrees relative to the center of the lid. In this example, while the living hinge 140 is a linear hinge, the lid peripheral portion 120 includes a protruding transition web region 142 for each latch, connecting the living hinge 140 to the edge of the lid peripheral region. To provide increased support to the linear hinges, the transition web regions extend angularly from each hinge end to the edge of the lid peripheral region, as shown in FIG. 6A, for example. Thus, while the lid peripheral region has a generally circular configuration in this embodiment, the transition web regions protrude from the generally circular configuration to allow wider latches, and thus enhanced latching force, while supporting the living hinges.

The latches 130 each include a hook or barb region 132 intermediate the hinge and the latch tip. The hook region 132 is configured to engage the lower edge 74A of the bowl wall 74 in a latch position. The hook or barb region 132, due to the width of the latch, includes a curved inwardly facing surface 132A (FIG. 6A), to generally match the curvature of the bowl edge, as visible in FIG. 6A, for example. The width of the hook region and its matching curvature enhance the latching force provided by the latch.

While the exemplary embodiment illustrated in FIGS. 1-7C employs four latches 130 at uniform spacing around the lid periphery, other embodiments may employ a fewer or a greater number of latches. For a container with dimensions of 7 inch diameter at the open top of the container, and a height of 3.2 inch, a wall 74 height of 0.4 inch, with a flat surface 72 width of 0.4 inch, and a seal width of 0.125 inch and height of 0.274 inch, four latches having a width of 2.75 inch and height of 1.25 inch each has been found suitable.

Figure 9:
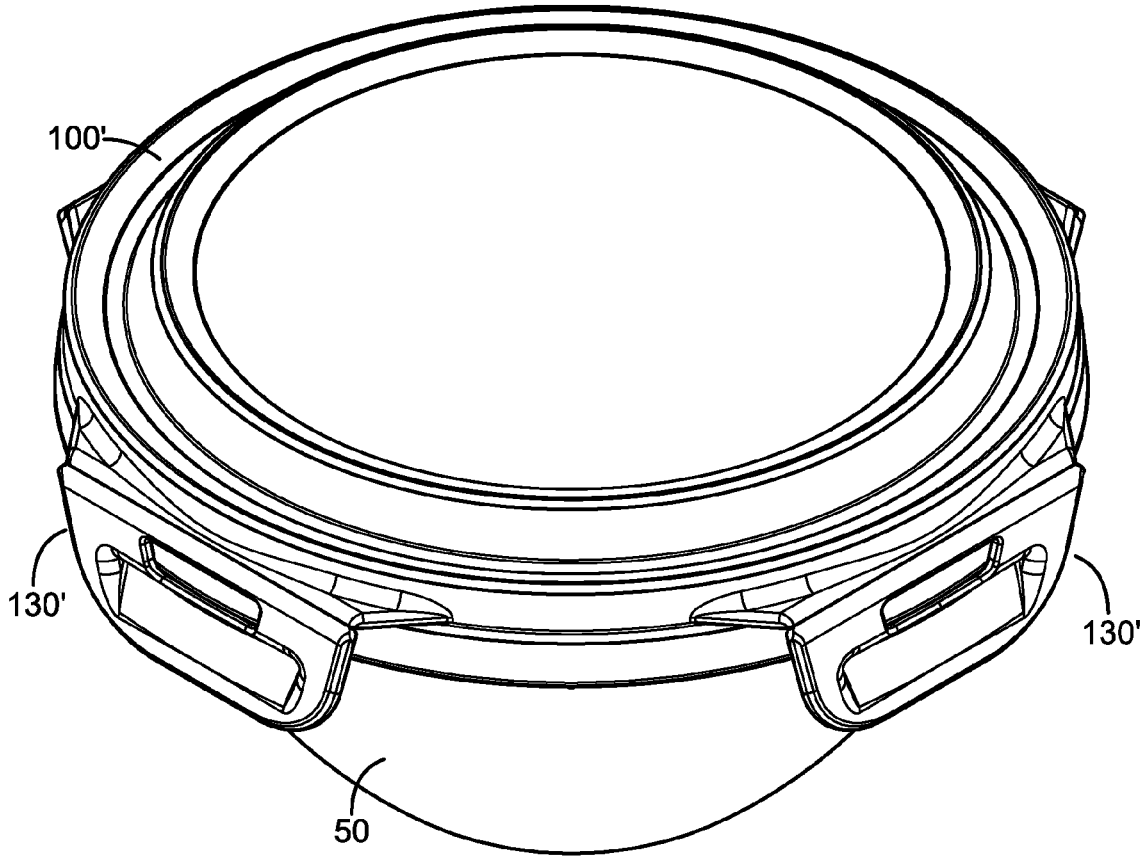
FIGS. 9, 9A, 9B, 9C, 9D and 9E illustrate an alternate embodiment of a lid for attachment to a container.
Figure 9A:
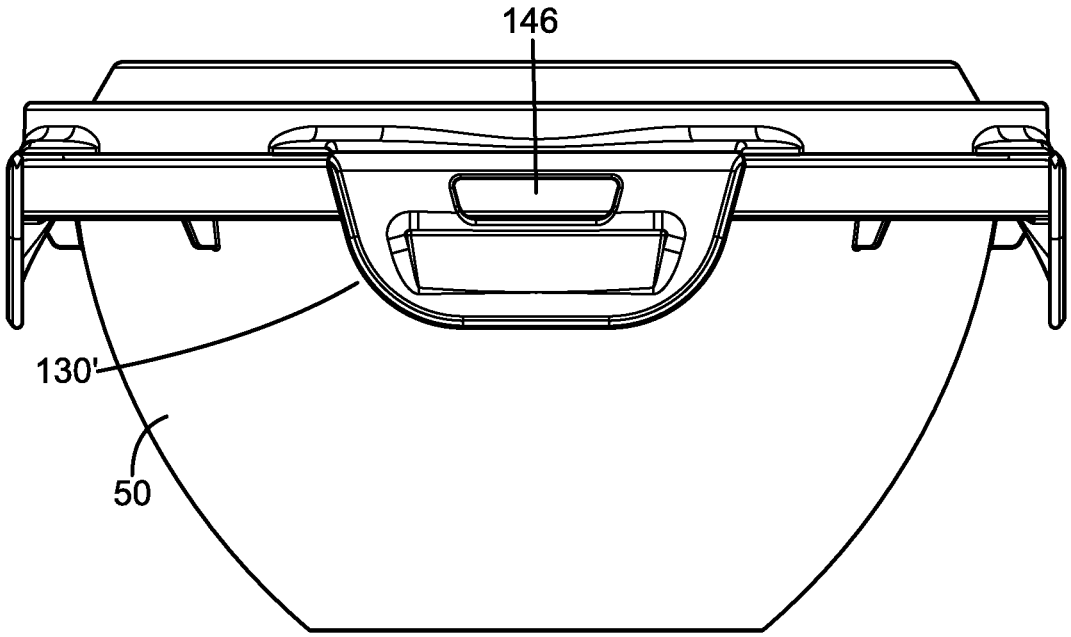
Figure 9B:
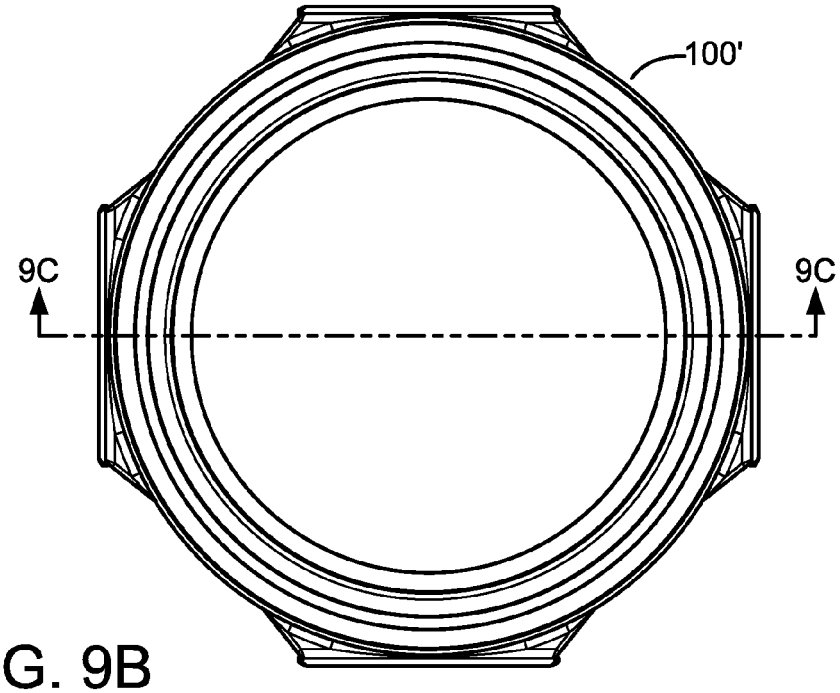
Figure 9C:
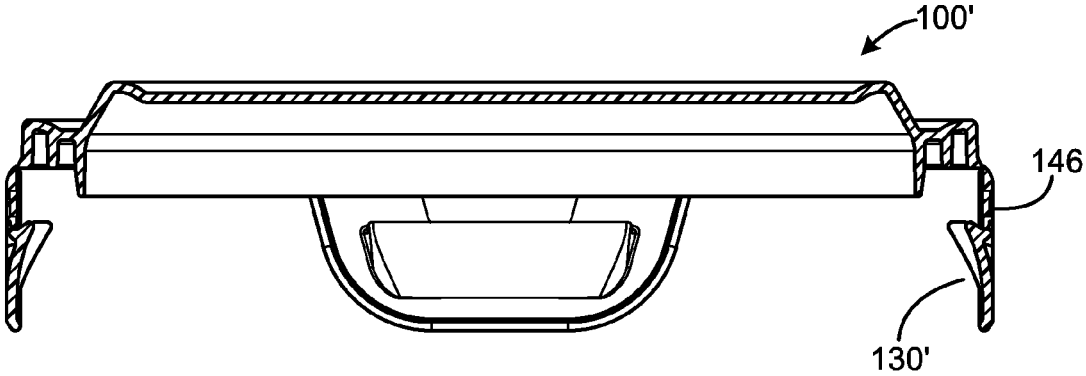
Figure 9D:
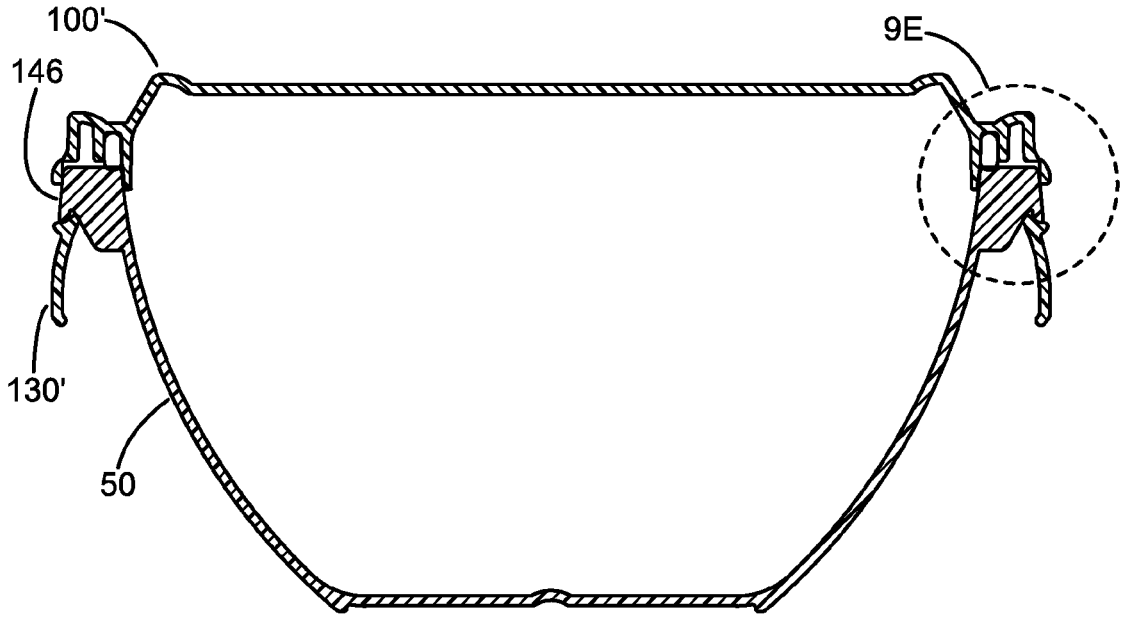
Figure 9E:
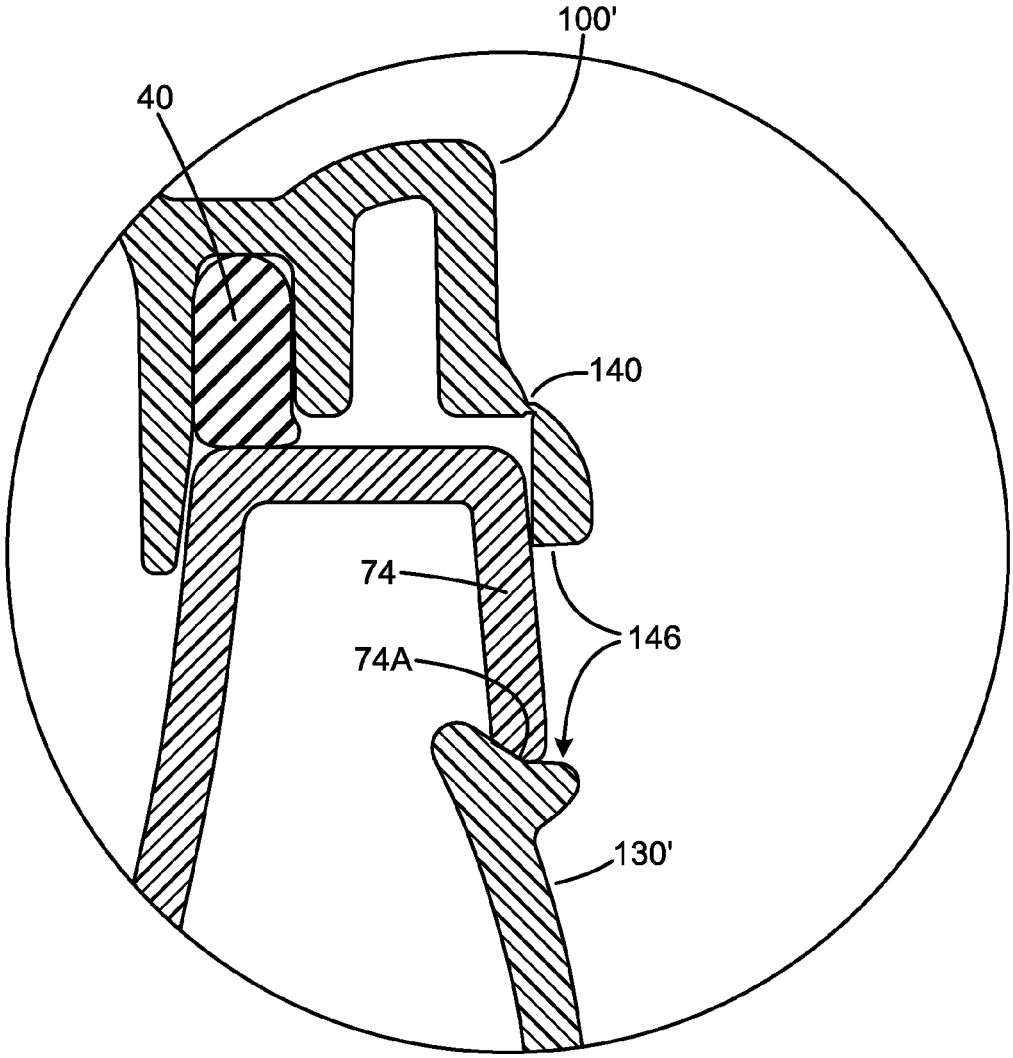

FIGS. 9-9E illustrate an alternate embodiment of a lid 100' for attachment to the container 50. The alternate lid embodiment is similar to lid 100, but includes a latch cutout or window 146 in each of the latches 130'. In this embodiment, the cutout extends heightwise when in a latched condition from about the height or level of the bowl rim to below the bottom surface 74A of the outer wall 74. The width of the cutout may depend on the diameter of the container, but in an exemplary embodiment for a container diameter of 7 inches and an outer wall depth of 0.4 inch, a cutout 0.2 inch high by 1 inch wide is satisfactory.

The cutout 146 allows for the rotation point of the latch (the latch or barb region of the latch to move inward. This feature allows hinge 140 to move into vertical alignment with 74A of the container, and reduces the negative effect caused by round vessels, where the latch hinge tends to be moved away from the lid and vessel.

The cutout or window feature could be exaggerated in other embodiments not shown by increasing the size of the cutout in the latch.

Although the foregoing has been a description and illustration of specific embodiments of the invention, various modifications and changes thereto can be made by persons skilled in the art without departing from the scope and spirit of the invention.

What is claimed is:

1. A sealed storage system, comprising:

a container defining a storage volume and having an open top, the open top circumscribed by a peripheral edge region defining a peripheral top surface and a downwardly extending skirt wall region spaced from an upper container wall portion, the skirt wall region having a distal edge;

an elastomeric seal member;

a lid member configured for attachment to the container to cover the open top in a sealing arrangement, the lid member fabricated as a unitary one-piece structure from a plastic material, the lid member comprising a cover portion and a lid peripheral portion including an annular web portion, and wherein an underside of the lid peripheral portion defines an inner peripheral channel in which the seal member is received, and an outer peripheral channel, the inner peripheral channel and the outer peripheral channel circumscribing the cover portion, and wherein the lid peripheral portion includes an intermediate wall portion separating the inner channel and the outer channel, and an outer wall portion defining an outer wall of the outer channel, the outer wall portion having a bottom edge distal from the annular web portion;

the lid member further comprising a plurality of latch portions each coupled to the bottom edge of the outer wall portion of the annular web portion with a connection portion comprising a living hinge portion, each latch portion having a hook portion extending inwardly to latch under the distal edge of said skirt wall region of the container; and wherein the plurality of latch portions are each rotatable about the living hinge portion between an open position and a latching position, the lid member and seal member configured such that, with the lid member disposed on the container and the plurality of latches brought into the latching position, the seal member is brought into compression against the peripheral top surface of the container in a sealed arrangement;

wherein the container has a bowl shape, the skirt wall region has a generally cylindrical shape, and the living hinge portion is a linear living hinge portion;

wherein the lid peripheral portion includes a protruding transition web region for each latch portion, connecting the living hinge portion to an edge of the lid peripheral region; and wherein each transition web region extends angularly from a living hinge end to the bottom edge of the outer wall portion of the lid peripheral region to allow wider latch portions and enhanced latching force, while supporting the living hinge portions.

2. The system of claim 1, wherein the top surface is an annular flat surface.

3. The system of claim 1, wherein the lid peripheral portion further includes an inner wall portion defining an inside wall portion of the inner peripheral channel, the inner wall portion protruding downwardly, and has an outer dimension sized in cooperation with an inner dimension of a top edge of the open top of the container, such that the inner wall portion fits into the open top and provides a lid alignment feature or rib, to align the lid member with the container as the lid member is being installed onto the container.

4. The system of claim 1, wherein the container further comprises a plurality of spaced rib portions extending between the upper container wall portion and the skirt wall region.

5. The system of claim 4, wherein each rib has a transverse bottom surface configured to provide a nesting stop surface for uniform stacking of like containers.

6. The system of claim 1, wherein the lid member cover portion includes a generally planar cover surface connected to the lid peripheral portion by a beveled or angled surface portion, facilitating stacking of similarly sized lid members.

7. The system of claim 1, wherein the seal member has a solid cross-sectional configuration.

8. The system of claim 7, wherein the seal member is an injection-molded unitary structure.

9. A sealed storage system, comprising:

a container defining a storage volume and having an open top, the open top circumscribed by a peripheral edge region defining a peripheral top surface and a downwardly extending skirt wall region spaced from an upper container wall portion, the skirt wall region having a distal edge, the container further comprising a plurality of spaced rib portions extending between the upper container wall portion and the skirt wall region;

an elastomeric seal member;

a lid member configured for attachment to the container to cover the open top in a sealing arrangement, the lid member comprising a cover portion and a lid peripheral portion including an annular web portion, and wherein an underside of the lid peripheral portion defines an inner peripheral channel in which the seal member is received, and an outer peripheral channel;

the lid member further comprising a plurality of latch portions each coupled to the annular web portion with a connection portion comprising a living hinge portion, each latch portion having a hook portion extending inwardly to latch under the distal edge of said skirt wall region of the container; and wherein the plurality of latch portions are each rotatable about the living hinge portion between an open position and a latching position, the lid member and seal member configured such that, with the lid member disposed on the container and the plurality of latches brought into the latching position, the seal member is brought into compression against the peripheral top surface of the container in a sealed arrangement; and wherein a latch relief region is defined in each rib portion adjacent the distal edge of the skirt wall region to allow a latch hook portion to engage under the distal edge without interference from the rib portion.

* * * * *